United States Patent [19]

Bilek et al.

[11] 4,224,064

[45] Sep. 23, 1980

[54] METHOD FOR REDUCING IRON CARBIDE FORMATION IN CAST NODULAR IRON

[75] Inventors: Paul J. Bilek, Danbury, Conn.; William A. Henning, Lewiston, N.Y.; Thomas K. McCluhan, North Tonawanda, N.Y.; Julian M. Dong, Youngstown, N.Y.

[73] Assignee: Union Carbide Corporation, New York, N.Y.

[21] Appl. No.: 34,128

[22] Filed: Apr. 27, 1979

[51] Int. Cl.[2] ..... C22C 33/08

[52] U.S. Cl. ..... 75/130 R; 75/53

[58] Field of Search ..... 75/53, 130 R, 58

[56] References Cited

U.S. PATENT DOCUMENTS

| | | | |
|---|---|---|---|
| 2,676,097 | 4/1954 | Strauss | 75/122 |
| 2,867,555 | 1/1959 | Curry | 75/130 R |
| 2,889,222 | 6/1959 | Kurzinski | 75/130 R |
| 3,033,676 | 5/1962 | Cox | 75/130 R |
| 3,527,597 | 9/1970 | Dawson | 75/130 R |
| 3,661,566 | 5/1972 | Percheron | 75/130 R |
| 3,905,809 | 9/1975 | Malizio | 75/53 |
| 3,955,973 | 5/1976 | Robinson | 75/130 R |

OTHER PUBLICATIONS

Rosenberg, "Making Cast Iron and Cast Steel Alloys", Technology Assessment & Forecast, Ninth Report, pp. 136–139, (U.S. Dept. Commerce, 1979).

Dong, Henning & Ward, "Effects of Barium/Cerium Combinations in Magnesium–Ferosilicon on Ductile Iron", 82nd Congress & Exposition of the American Foundrymen's Society, (Apr. 1978).

*Primary Examiner*—P. D. Rosenberg

*Attorney, Agent, or Firm*—John R. Doherty

[57] ABSTRACT

A method for the production of cast nodular or ductile iron wherein molten iron having been first contacted with a graphite-spheroidizing agent is after-treated with an alloy consisting essentially of silicon, calcium, magnesium, aluminum, cerium, barium, and iron so as to reduce the formation of iron carbides or chill in the resulting cast nodular iron.

7 Claims, No Drawings

METHOD FOR REDUCING IRON CARBIDE FORMATION IN CAST NODULAR IRON

The present invention relates to a method to reduce the formation of iron carbides or chill in cast nodular iron, i.e. ductile iron. More particularly, the present invention relates to a method for the production of cast nodular iron wherein molten iron which has been first contacted with a graphite-spheroidizing agent is after-treated with an alloy inoculant consisting essentially of silicon, calcium, magnesium, aluminum, cerium, barium and iron so as to reduce the formation of iron carbides or chill in the cast nodular iron.

BACKGROUND OF THE INVENTION

Cast iron contains carbon as a major alloying element which is usually present in the form of graphite flakes. Processes have been developed wherein graphite-spheroidizing agents are introduced into molten iron prior to casting causing the graphite flakes in the cast iron to assume a spheroidal, i.e., nodular form. This results in a cast iron of increased strength and ductility referred to in the art as ductile or nodular iron. A number of elements (e.g. magnesium, cerium, calcium) are known in the art to be graphite-spheroidizing agents i.e. nodularizing agents. Methods known to the art for the production of nodular cast iron are described, for example, in U.S. Pat. No. 3,905,809—Malizio et.al.

During the casting and solidification of nodular cast iron there is a tendency for iron carbides or chill to form near the surface of the cast iron especially in thin sections of a casting. The formation of these iron carbides is disadvantageous as they can cause the cast iron to be so hard that machining of the casting is impractical. In many instances, the presence of high levels of iron carbide results in castings either being scrapped or requiring expensive heat treatment before machining.

In order to deter the formation of iron carbide in nodular cast iron, various "inoculants" have been developed. An inoculant is a relatively small addition to molten iron, which has been previously contacted with a graphite-spheroidizing agent; the inoculant addition serves to suppress the formation of disadvantageous iron carbides in the cast nodular iron. Inoculants are also used to reduce the amount of the graphite-spheroidizing agent addition required to be introduced into the molten iron without detrimentally affecting the metallurgical or physical properties of the resulting nodular iron product. Typical inoculants known to the art are calcium and aluminum bearing ferrosilicon alloys. It is also known to the art that the addition of magnesium to these calcium and aluminum bearing ferrosilicon alloys increases the effectiveness of the inoculant. Barium is also known to improve the effect of inoculating alloys. Prior art methods for the use of inoculants in nodular cast iron are described, for example, in U.S. Pat. No. 3,995,973—Robinson and U.S. Pat. No. 3,661,566—Percheron et.al.

OBJECT OF THE INVENTION

It is therefore an object of the present invention to provide an economic and effective method for the production of nodular cast iron so as to reduce the formation of iron carbides or chill in the nodular cast iron.

It is a further object of the present invention to provide an economic and effective method for the production of nodular cast iron by after-treating molten iron previously contacted with a graphite-spheroidizing agent with an alloy inoculant so as to reduce the formation of iron carbides or chill in the nodular cast iron.

Other objects of the invention will be apparent from the following description and claims.

SUMMARY OF THE INVENTION

The present invention comprises a method for the production of cast nodular iron wherein molten iron having been first contacted with a graphite-spheroidizing agent in an amount sufficient to substantially spheroidize the graphite in the resulting cast iron is after-treated with an alloy consisting essentially of silicon, calcium, magnesium, aluminum, cerium, barium and iron so as to reduce the formation of iron carbides or chill in the resulting cast nodular iron.

DESCRIPTION OF THE PREFERRED EMBODIMENTS

In the practice of a particular embodiment of the method of the present invention, an alloy to be used as an inoculant consisting essentially of about 45 percent to 80 percent by weight silicon, 0.5 percent to 1.5 percent by weight calcium, 0.5 percent to 2.5 percent by weight magnesium, 0.5 percent to 1.5 percent by weight aluminum, 0.5 percent to 1.5 percent by weight cerium, 0.5 percent to 1.5 percent by weight barium balance iron with incidental impurities is conventionally prepared. Preferably, the ranges of the constituents are about 72 percent to 78 percent by weight silicon, 1 percent to 1.25 percent by weight calcium, 1 percent to 2 percent by weight magnesium, 0.5 percent to 1.0 percent by weight aluminum, 0.7 percent to 1.25 percent by weight cerium, 0.7 percent to 1.25 percent by weight barium balance iron with incidental impurities.

A molten iron bath is prepared by melting pig iron, steel, cast scrap or any other conventional starting material in a conventional manner well known to the art. The molten iron is then contacted with a known graphite-spheroidizing agent, i.e. nodularizing agent, compatible with the present invention using a technique known to the art and in an amount sufficient to yield from about 0.02 to about 0.07 percent by weight of the graphite-spheroidizing agent in the cast nodular iron. Examples of such graphite-spheroidizing agents suitable for use are magnesium, cerium, calcium and other rare earth elements.

The preferred graphite-spheroidizing agent for the practice of the present invention is magnesium.

In the practice of the method of the present invention, a pouring ladle is preheated to about 1100° to 1125° C. The molten iron, which as hereinbefore described has been contacted with the graphite-spheroidizing agent, is transferred into the pouring ladle and the hereinbefore described inoculant alloy is introduced into the molten iron. The molten iron is suitably stirred a brief period of time (e.g. about 5 to 10 seconds) to aid the dissolution of the inoculant alloy in the molten iron. In industrial scale operations, one skilled in the art may fine it preferable to introduce the inoculant alloy into the stream of the molten iron being transferred. The turbulence of the molten iron entering the pouring ladle mixes the inoculant with the molten iron.

The amount of the inoculant alloy introduced into the molten iron is suitably about 0.4 percent to 0.9 percent by weight of the molten iron transferred into the ladle and preferably about 0.6 percent to 0.7 percent by weight of the molten iron.

The inoculant alloy of the method of the present invention is preferably in the form of a crushed alloy but may be in powdered form. Suitable sizes would range for example between $\frac{3}{8}$ inch×32 mesh to 60 mesh×325 mesh. (Mesh sizes are Tyler series.)

The inoculated molten iron is suitably poured into a conventional casting mold about $\frac{1}{2}$ minute to 15 minutes and preferably $\frac{1}{2}$ minute to 5 minutes after the inoculant first contacts the molten iron. Delays from the time of inoculation to the time of casting may result in the fading of the effectiveness of the inoculant of the method of the present invention in reducing the formation of iron carbides.

Other modes for the practice of the method of the present invention will be apparent to those skilled in the art.

To more particularly illustrate the present invention various tests were performed as described in the following example:

EXAMPLE

A series of tests were conducted in which molten iron heats were prepared in a magnesia-lined high frequency induction furnace with a graphite cover. For each heat, the furnace was initially charged with 45 kilograms of approximately 87 percent low phophorus pig iron (about 3.75% C, 1.1% Si, 0.015% P, 0.013% S, 0.047% Ti, 0.21% Mn balance iron) and approximately 13 percent high purity iron (about 0.005% P, 0.009% S, 0.05% Mn, 0.05% C balance iron). The iron was melted down and the molten iron bath was maintained at a temperature of about 1500° to 1510° C. A partial argon atmosphere was maintained over the molten charge throughout each heat, except during slag removal, by feeding the argon metered in at about 0.283 to 0.284 cubic meters per hour through a 1.2 cm. diameter pipe threaded into the graphite cover.

After meltdown, the slag was removed and additions of low aluminum silicon (0.10% Al maximum) and electrolytic magnanese were made to adjust the composition of the base molten iron to an aim composition of approximately:

| | |
|---|---|
| 3.6% | total carbon |
| 1.3% | silicon |
| 0.6% | manganese |
| 0.01% | phosphorous |
| 0.01% | sulfur |
| balance | essentially iron |

To insure that chemical variations between heats were minimal and that the aim composition was substantially achieved for each heat, charge components for the heats were taken from the same lots of raw materials and pin tube samples of each base iron were taken and analyzed.

Once final alloy additions were made to achieve the aim composition of the molten iron, the bath temperature was stabilized and held at about 1510° C. (2750° F.).

All heats were tapped in five 7 kilogram increments into clay-graphite ladles that had been preheated to about 1125° C. (2057° F.) in a gas-fired, baffle furnace. The amount of iron poured into each ladle was measured by a platform scale used to support the ladle during the tap.

Each 7 kilogram batch of iron was then poured into another clay-graphite ladle preheated to about 1125° C. which held 140 grams of a nodularizing or graphite-spheroidizing alloy with an analysis of:

| | |
|---|---|
| 45.20% | silicon |
| 1.07% | aluminum |
| 5.52% | magnesium |
| 0.39% | cerium |
| 0.93% | calcium |
| balance | essentially iron |

This amount of the described graphite-spheroidizing agent is sufficient to yield about 0.030 to 0.045 percent magnesium and about 0.004 to 0.007 percent cerium in the hereinafter described cast nodular iron.

The dross was removed from the molten iron and approximately 1 minute after the graphite-spheroidizing treatment the molten iron was inoculated with 42 grams (approximately a 0.6% addition based on the weight of molten iron) of an alloy the composition of which is described in Table I. The inoculation was made by adding the alloy in crushed form ($\frac{3}{8}$ inch×32 mesh Tyler) to the molten iron and stirring briefly (approximately 5 to 10 seconds) with a steel rod to aid dissolution.

The inoculated iron was allowed to cool to about 1325° C. (2417° F.) and was then cast in a baked oil sand mold which formed a cast iron specimen having a fin-like member projecting from the specimen which represents a thin section of a casting wherein iron carbides have a tendency to form.

The time from inoculation to casting was approximately 2 to 3 minutes.

The bath, ladle and casting temperatures were monitored by platinum/platinum—10% rhodium thermocouples in order to insure temperature differences between heats were minimal.

After solidification of the cast specimen, the fin ($1\frac{3}{8}$ inch×$\frac{5}{8}$ inch×$\frac{1}{4}$ inch) was cut from the casting. A test specimen ($\frac{1}{4}$ inch×$\frac{5}{8}$ inch×$\frac{1}{4}$ inch) was cut from the approximate mid-section of the fin. The cut surface located at the approximate midsection of the fin was prepared for microstructural analysis by polishing to a 1 micron finish with a cloth covered polishing wheel impregnated with a 1 micron diamond grit. Nodule counts were made on the polished surface of the test specimen with an image analyzing microscope at 650× power approximately 1/16 inch from a cast surface of the specimen along a line extending approximately $\frac{1}{4}$" running parallel to the cast surface of the specimen.

Nodule counts for specimens of each inoculant are recorded in Table I in nodules per square millimeter.

Two castings were also made following the same procedure for nodularized iron without the addition of an inoculant. Nodule counts were made in the same manner with the results recorded in Table I as test 10.

It is known that high nodule counts coincide with a low tendency to form iron carbides. Therefore, nodule count data was made since this data can be accurately obtained from cast ductile iron while iron carbide levels are difficult to measure.

In Table I, the alloy of Tests 1, 4, and 7 is a commercially available type inoculant consisting essentially of silicon, calcium, magnesium, aluminum, balance essentially iron and is designated a type A inoculant.

TABLE I

| Test | Type | % Si | % Ca | % Mg | % Al | % Ce | % Ba | Balance | Nodules/mm$^2$ |
|---|---|---|---|---|---|---|---|---|---|
| | | Composition of Alloys Used as Inoculants | | | | | | | |
| 1 | A | 46.51 | 0.85 | 1.29 | 0.88 | — | — | Fe | 447 |
| 2 | C | 47.70 | 1.14 | 1.70 | 1.04 | 1.13 | — | Fe | 491 |
| 3 | P | 48.45 | 1.07 | 1.60 | 0.88 | 1.05 | 0.72 | Fe | 587 |
| 4 | A | 47.56 | 0.93 | 1.61 | 1.21 | — | — | Fe | 356* |
| 5 | B | 47.93 | 1.04 | 1.59 | 1.14 | — | 1.14 | Fe | 428* |
| 6 | P | 48.89 | 0.95 | 1.50 | 1.12 | 1.12 | 1.17 | Fe | 493* |
| 7 | A | 72.91 | 1.06 | 1.39 | 0.85 | — | — | Fe | 412* |
| 8 | B | 74.08 | 1.06 | 1.41 | 0.82 | — | 1.16 | Fe | 479* |
| 9 | P | 75.01 | 1.25 | 1.33 | 0.88 | 1.08 | 1.16 | Fe | 543* |
| 10 | | NO INOCULANT | | | | | | | 347** |

*Average of 3 Tests
**Average of 2 Tests

The alloy of Tests 5 and 8 is an inoculant consisting essentially of silicon, calcium, magnesium, aluminum, barium, balance essentially iron and is designated a type B inoculant. The alloy of Test 2 is an inoculant consisting essentially of silicon, calcium, magnesium, aluminum, cerium, balance essentially iron and is designated a type C inoculant. The alloy of Tests 3, 6, and 9 is an inoculant in accordance with the method of the present invention consisting essentially of critical quantities of silicon, calcium, magnesium, aluminum, barium, cerium, balance essentially iron and is designated a type P inoculant.

A comparison of the nodule counts resulting from the tests recorded in Table I demonstrates that the use of the P type inoculant in accordance with the method of the present invention results in substantially higher nodule counts and hence a substantially lower tendency to form iron carbides than the use of the type A, B or C inoculant.

The results of Table I further demonstrates that the use of critical quantities of barium and cerium in addition to critical quantities of silicon, calcium, magnesium, and aluminum in the type P inoculant in accordance with the method of the present invention results in substantially higher nodule counts and hence a substantially lower tendency to form iron carbides than the use of barium (type B inoculant) or the use of cerium (type C inoculant) singly in combination with silicon, calcium, magnesium and aluminum.

What is claimed is:

1. In the production of cast nodular iron from molten iron which has been contacted with a graphite-spheroidizing agent in an amount sufficient to yield from about 0.02 to about 0.07 percent by weight of the graphite-spheroidizing agent in the cast nodular iron, a method to reduce the formation of iron carbides in said cast nodular iron which comprises after-treating said molten iron previously contacted with said graphite-spheroidizing agent with an alloy consisting essentially of about 45 percent to 80 percent by weight silicon, 0.5 percent to 1.5 percent by weight calcium, 0.5 percent to 2.5 percent by weight magnesium, 0.5 percent to 1.5 percent by weight aluminum, 0.5 percent to 1.5 percent by weight cerium, 0.5 percent to 1.5 percent by weight barium balance essentially iron.

2. A method in accordance with claim 1 wherein the after-treating alloy consists essentially of about 72 percent to 78 percent by weight silicon, 1 percent to 1.25 percent by weight calcium, 1 percent to 2 percent by weight magnesium, 0.5 percent to 1.0 percent by weight aluminum, 0.7 percent to 1.25 percent by weight cerium, 0.7 percent to 1.25 percent by weight barium balance essentially iron.

3. A method in accordance with claim 1 wherein said after-treating alloy is about 0.4 percent to 0.9 percent by weight of said molten iron.

4. A method in accordance with claim 1 wherein said after-treating alloy is about 0.6 percent to 0.7 percent by weight of said molten iron.

5. A method for the production of cast nodular iron from molten iron which comprises first contacting the molten iron with a graphite-spherodizing agent containing at least one element selected from the group consisting of magnesium, cerium and calcium, in an amount sufficient to yield from about 0.02 to about 0.07 percent by weight of the graphite-spheroidizing agent in the cast nodular iron, and then treating the molten metal with an alloy to reduce the formation of iron carbides in the cast nodular iron, said alloy consisting essentially of about 45 percent to 80 percent by weight silicon, 0.5 percent to 1.5 percent by weight calcium, 0.5 percent to 2.5 percent by weight magnesium, 0.5 percent to 1.5 percent by weight aluminum, 0.5 percent to 1.5 percent by weight cerium, 0.5 percent to 1.5 percent by weight barium balance essentially iron.

6. A method in accordance with claim 5 wherein the graphite-spheroidizing agent contains predominantly silicon and iron along with relatively small amounts of aluminum, magnesium, cerium and calcium and is present in an amount sufficient to yield from about 0.030 to about 0.045 percent magnesium and from about 0.004 to about 0.007 percent cerium in the cast nodular iron.

7. A method in accordance with claim 6 wherein the graphite-spheroidizing agent consists essentially of about 45.20 percent by weight silicon, 1.07 percent by weight aluminum, 5.52 percent by weight magnesium, 0.39 percent by weight cerium, 0.93 percent by weight calcium balance essentially iron.

* * * * *